United States Patent [19]

Huerstel

[11] Patent Number: 4,655,452

[45] Date of Patent: Apr. 7, 1987

[54] BATTING PRACTICE DEVICE

[76] Inventor: Eugene W. Huerstel, 10055 - 204th St. North, Forest Lake, Minn. 55025

[21] Appl. No.: 695,296

[22] Filed: Jan. 28, 1985

[51] Int. Cl.[4] ..... A63B 69/40

[52] U.S. Cl. ..... 273/26 R; 272/132

[58] Field of Search ..... 273/26 D, 29 B; 124/78, 124/79, 81

[56] References Cited

U.S. PATENT DOCUMENTS

| | | | |
|---|---|---|---|
| 3,118,670 | 1/1964 | Smith | 273/26 |
| 3,271,030 | 9/1965 | Mueller | 273/26 |
| 3,386,733 | 6/1968 | Russo et al. | 273/26 |
| 3,937,464 | 2/1976 | Zalewski | 273/26 |
| 3,940,131 | 2/1976 | St. Claire, Jr. | 273/26 |
| 4,086,903 | 5/1978 | Scott | 124/78 |
| 4,097,044 | 6/1978 | Miniere | 273/26 |
| 4,258,916 | 3/1981 | Beam | 273/26 |
| 4,423,717 | 1/1984 | Kahelin | 273/26 D |
| 4,451,036 | 5/1984 | Sinclair | 273/26 |

FOREIGN PATENT DOCUMENTS

| | | | |
|---|---|---|---|
| 2262880 | 6/1974 | Fed. Rep. of Germany | 124/78 |
| 502922 | 3/1920 | France | 124/78 |
| 2107199 | 4/1983 | United Kingdom | 273/29 B |

*Primary Examiner*—Richard C. Pinkham
*Assistant Examiner*—T. Brown
*Attorney, Agent, or Firm*—Kinney & Lange

[57] ABSTRACT

A batting practice device includes an extensible frame which is pivotally mounted to a base and oriented in a generally vertical position. An upper arm is pivotally mounted to the frame and extends in a direction generally perpendicular to the frame. An upper wheel is rotatably mounted to the upper arm for rotation about an axis generally perpendicular to the frame. A lower arm is rigidly mounted to the frame at a position below the upper arm and extends in a direction generally perpendicular to the frame. A lower wheel is rotatably mounted to the lower arm for rotation about an axis generally perpendicular to the frame. Outer circumferences of the upper and lower wheels cooperate to form a nip through which a bat is swung during practice. An adjustable bias means urges the upper and lower wheels together. The frame may be raised and lowered to accommodate batters of differing heights and tilted to simulate different types of pitches.

34 Claims, 8 Drawing Figures

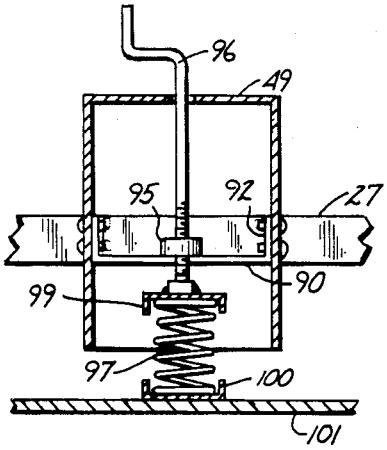
Fig.5
Fig.1
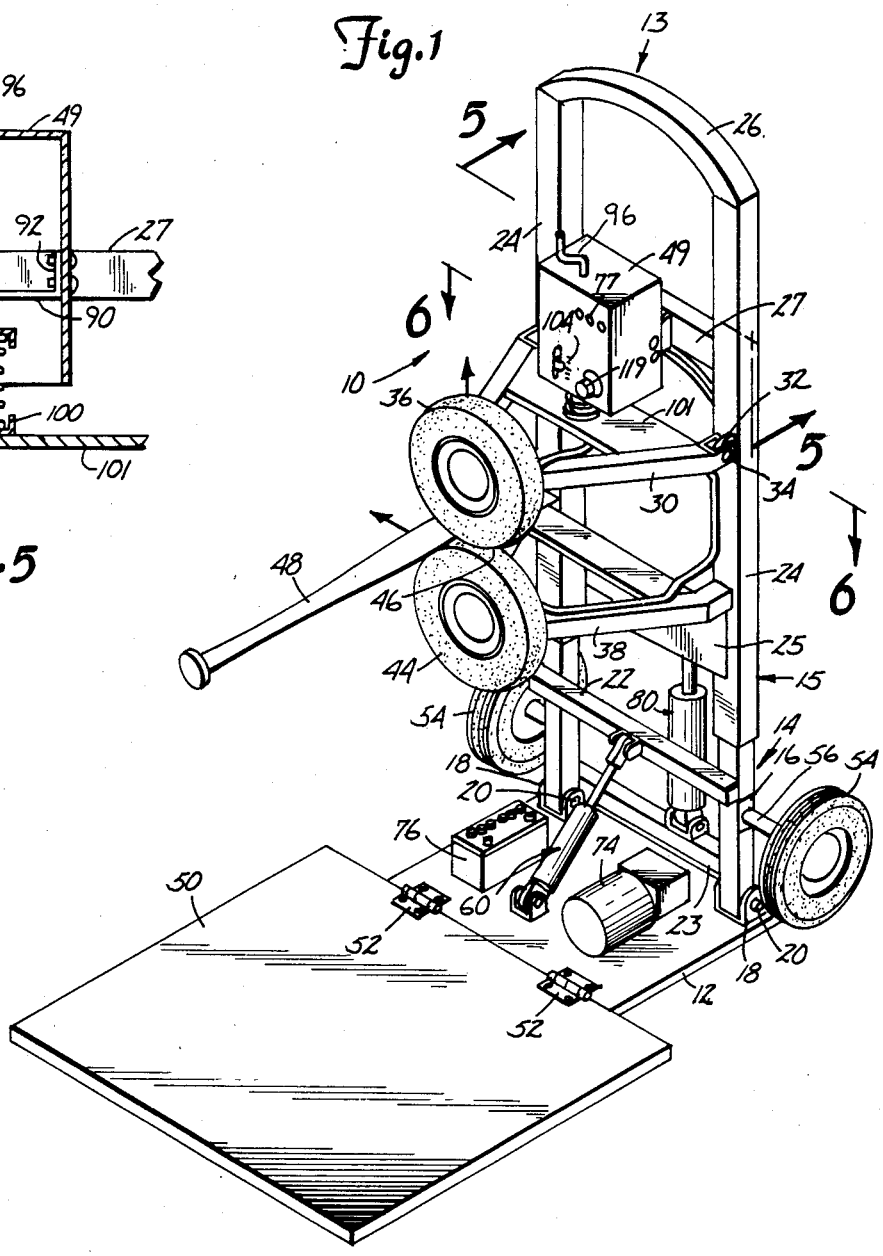
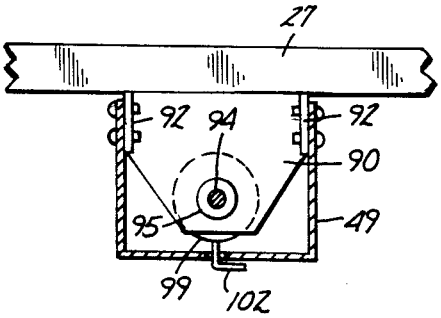
Fig.6
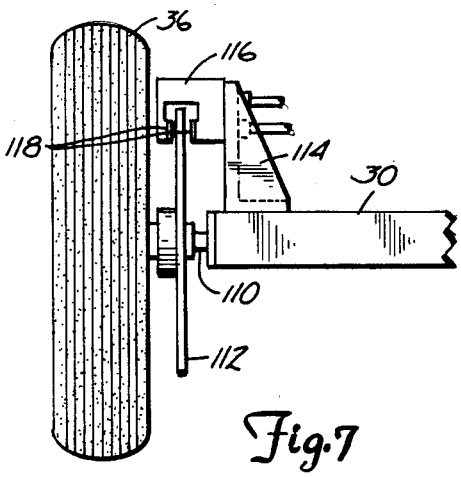
Fig.7

BATTING PRACTICE DEVICE

BACKGROUND OF THE INVENTION

1. Field of the Invention

The present invention relates to athletic training devices. In particular, the invention is a baseball batting practice device.

2. Description of the Prior Art

Any discussion of a great baseball player will undoubtedly include a reference to such statistics as batting average, home runs and runs batted in. Batting skills are in fact one of a baseball player's greatest assets. The player will typically devote much time and effort to develop these skills.

Batting practice is one commonly-used training technique. By repeatedly swinging a bat the batter will develop the hand-eye coordination and muscles required to consistently hit pitches during a game. The prior art discloses a variety of devices which assist in this training.

U.S. Pat. No. 3,118,670 to Smith discloses a pair of simulated baseballs mounted to opposite ends of an arm. The center of the arm is rotatably mounted to a post. U.S. Pat. No. 3,940,131 issued to St. Clair, Jr. discloses a stand which supports a baseball. The batter must have a level swing to hit the ball. The Mueller U.S. Pat. No. 3,271,030, Zalewski U.S. Pat. No. 3,937,464 and Beam U.S. Pat. No. 4,258,916 disclose batting practice devices in which a baseball is resiliently mounted to a frame. These devices return the baseball to the practice position after it has been struck by the bat. U.S. Pat. No. 4,097,044 to Miniere discloses a batting practice device in which a target, such as an automobile tire, is pivotally mounted to a support.

The Russo et al U.S. Pat. No. 3,386,733 discloses a batting practice device in which a pair of target members extend inwardly from either side of a C-shaped frame. The overlap of the two target members can be adjusted to vary the amount of force required to swing the bat through the two target members. U.S. Pat. No. 4,451,036 to Sinclair discloses a device whereby a batter must swing the bat through a plurality of vertically disposed resilient members. By adjusting the overlap of the resilient members the force of the swing required by the batter can be varied.

What is needed is a batting practice device which closely simulates the "feel" of a baseball when struck. The force which the practice device applies to the bat when struck should be adjustable to allow for the batter's increasing strength. The device should absorb the shock of the hit and prevent rebounding. A batting practice device allowing for easy height adjustment to accommodate different size batters is desirable. The batting practice device should allow a batter to practice swinging at outside and inside pitches as well.

SUMMARY OF THE INVENTION

The present invention is a baseball batting practice device. The device is easily adjusted to accommodate batters of different heights. The device is also adjustable to allow a batter to practice swinging at different types of pitches.

The batting practice device includes a frame which is mounted to a base and oriented in a generally vertical position. A first wheel means having an outer circumference is mounted with respect to the frame for rotation about an axis generally perpendicular to the frame.

A second wheel means having an outer circumference is mounted with respect to the frame for rotation about an axis generally perpendicular to the frame. Also included are means for mounting the first and second wheel means to the frame and for allowing relative movement therebetween. The outer circumferences of both the first wheel means and the second wheel means cooperate to define a nip through which the bat is swung during practice. Bias means provide a force urging the outer circumferences of the first and second wheel means together.

In preferred embodiments of the present invention, the means for mounting the first and second wheel means to the frame includes an upper arm pivotally mounted to the frame and extending in a direction generally perpendicular to the frame. The upper wheel means is rotatably mounted to the upper arm. A lower arm is rigidly mounted to the frame at a position below the upper arm and extends in a direction generally perpendicular to the frame. The lower wheel means is rotatably mounted to the lower arm.

Preferably, the batting practice device also includes means for raising and lowering the frame with respect to the base. The frame is also preferably pivotally mounted to the base, and means for orienting the frame in positions tilted with respect to the base are included.

In order to vary the force required of the batter during the practice swing, the invention preferably includes means for adjusting the bias means urging the outer circumferences of the upper and lower wheel means together. Means for varying a resistance to rotation of the upper and lower wheels are also included for this purpose. To prevent shock and rebounding, the outer circumferences of the upper and lower wheels are formed of a soft polyurethane material. Finally, the batting practice device preferably includes wheels which are rotatably attached to the lower portion of the frame to allow the batting practice device to be conveniently rolled to or from the practice area.

BRIEF DESCRIPTION OF THE DRAWINGS

FIG. 1 is a perspective view of the batting practice device;

FIG. 5 is a detailed view taken along lines 5—5 of FIG. 1 and showing the bias means;

FIG. 6 is a detailed sectional view taken along lines 6—6 of FIG. 1 and showing the bias means; and FIG. 7 is a detailed view of a disk brake apparatus used to vary a resistance to rotation of the upper and lower wheels.

DETAILED DESCRIPTION OF THE PREFERRED EMBODIMENTS

Figure 2:
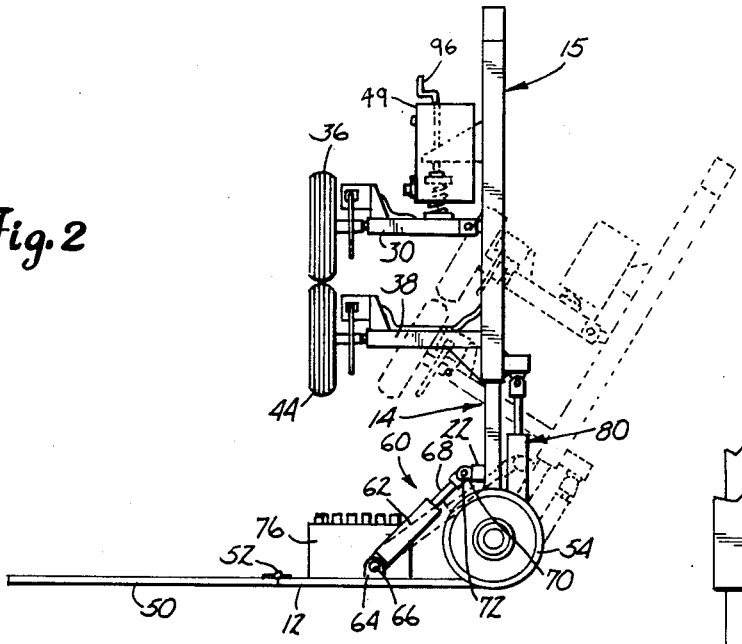
FIG. 2 is a side view and shows in broken lines the batting practice device tilted outward.
Figure 3:
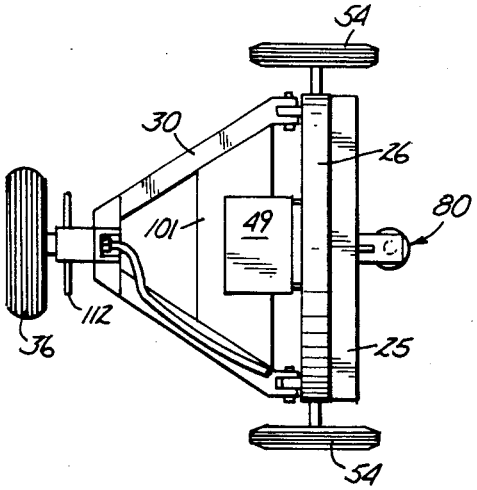
FIG. 3 is a top view of the batting practice device.

Batting practice device 10 of the present invention is illustrated generally in FIGS. 1–3. Base 12 is used to support the device. Frame 13 is pivotally attached to base 12 and is oriented in a generally vertical position. As shown in FIG. 1, frame 13 is an extensible, telescoping frame and includes lower section 14 and upper section 15.

Lower section 14 is formed by beams 16 which are pivotally attached to base 12 by means of brackets 18 and pivot pins 20. Cross supports 22 and 23 are rigidly attached to both beams 16 for additional support. Beams 16 are preferably made from rigid steel tubing. Upper section 15 of frame 13 is comprised of sleeves 24, lower cross supports 25 and 27 and top support 26. Sleeves 24 are made from rigid steel tubing and have a cross section adapted to slidably fit over beams 16. Top support 26 is attached to top ends of sleeves 24 to provide the necessary rigidity of the frame 13. The upper section 15 slides up and down on lower section 14 to provide for height adjustments.

Upper arm 30 is pivotally mounted to an upper part of upper section 15 of frame 13. In a preferred embodiment, upper arm 30 is generally V-shaped having its open ends mounted to brackets 32 on sleeves 24 by means of pivot pins 34. As shown, upper arm 30 extends in a generally perpendicular direction with respect to the frame. Upper wheel 36 is rotatably mounted to a middle section of upper arm 30. Upper wheel 36 rotates about an axis which is generally perpendicular to frame 13.

A lower arm 38 is rigidly mounted to upper section 15 at a position below upper arm 30. Lower arm 38 is generally V-shaped and has its open ends mounted to sleeves 24. Lower arm 38 is mounted in a generally perpendicular direction with respect to frame 13. A lower wheel 44 is rotatably mounted to a middle portion of lower arm 38. Lower wheel 44 is mounted for rotation about an axis generally perpendicular to frame 13.

As shown in FIG. 1, upper wheel 36 and lower wheel 44 are coplanar. Outer circumferences of upper wheel 36 and lower wheel 44 cooperate to define nip 46 at their intersection. During batting practice a batter will swing bat 48 and strike nip 46. Since arm 30 is pivotally mounted, upper wheel 36 will swing away from lower wheel 44 as bat 48 passes through nip 46. A bias means mounted within control box 49 and shown in detail in FIGS. 5 and 6 is used to urge the outer circumferences of upper wheel 36 and lower wheel 44 together. In the embodiment shown in FIGS. 1 and 2, wheels 36 and 44 are biased in such a manner that their outer circumferences are in contact with each other. In other embodiments it has been found to be advantageous to bias wheels 36 and 44 in a manner that keeps their outer circumferences spaced from one another by a small distance. After bat 48 has passed between upper and lower wheels 36 and 44, respectively, the bias means will force the wheels back together. Batting practice device 10 can therefore be repeatedly used without being reset by the batter.

Batting stand 50 is mounted to base 12 by means of hinges 52. A batter will stand on batting stand 50 while practicing his swing with batting practice device 10. Stand 50 can be folded onto practice device 10 for ease of transportation. In a preferred embodiment, stand 50 is made of plywood and covered by an artificial grass surface.

Batting practice device 10 also includes cartage wheels 54 which are rotatably mounted to lower section 14 of frame 13. As shown in FIG. 1, cartage wheels 54 are mounted to beams 16 by means of axles 56. When batting practice stand 50 is folded onto frame 13, batting practice device 10 is easily tipped on its side onto cartage wheels 54 and pulled to its storage position.

FIG. 2 illustrates a preferred technique for supporting frame 13 in a position tilted with respect to base 12. Hydraulic jack 60 includes cylinder 62 which is pivotally mounted to base 12 by means of bracket 64 and pivot pin 66. Piston arm 68 of hydraulic jack 60 is pivotally attached to cross support 22 of frame 13 by means of bracket 70 and pivot pin 72. By actuating hydraulic jack 60 it is possible to tilt frame 13, and therefore nip 46, backwards as illustrated by the broken lines in FIG. 2. Similarly, it is possible to tilt frame 13 inward although this is not shown in FIG. 2. By tilting frame 13, and therefore nip 46, batting practice device 10 can be used to simulate a variety of pitches.

As shown in FIG. 1, hydraulic jack 60 is driven by means of pump 74. Pump 74 is in turn driven by battery 76. Switches 77, shown mounted on control box 49, are used to actuate pump 74. Although this apparatus is advantageous in that it is easy to use, it is not required. Alternatively, hydraulic jack 60 is hand operated, or other devices including a ratchet or screw jack are used to tilt and support frame 13.

Figure 4:
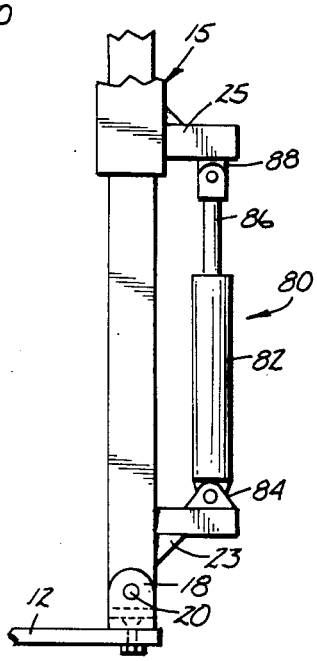
FIG. 4 is a detailed view of the hydraulic jack used to raise and lower the frame.

FIG. 4 illustrates a preferred apparatus for raising and lowering upper section 15 of frame 13. Hydraulic jack 80 has a cylinder 82 mounted to bracket 84 of cross support 23 of lower section 14 of frame 13. Piston arm 86 of hydraulic jack 80 is mounted to bracket 88 which is in turn attached to lower cross support 25 of extensible section 15. Hydraulic jack 80 is driven by pump 74. By actuating hydraulic jack 80, extensible section 15 of the frame 13 can be raised and lowered with respect to base 12. The height of nip 46 is thereby adjusted to accommodate batters of various heights.

FIGS. 5 and 6 illustrate a preferred method of biasing upper wheel 36 and lower wheel 44 together. Plate 90 is mounted to cross support 27 and forms a plane which is generally perpendicular to frame 13. Brackets 92 are also mounted to cross support 27 and provide additional support for plate 90. Bore 94 is formed within plate 90. Threaded nut 95 is mounted to plate 90 with its threads aligned with bore 94. Threaded crank 96 is adapted to fit within threaded nut 95.

Helical spring 97 is positioned within upper and lower cup-shaped members 99 and 100, respectively. Lower cup member 100 is mounted in an upwardly opening direction to cross member 101 which extends across the open portion of upper arm 30. Upper cup member 99 is mounted in a downwardly opening direction to a lower end of crank 96.

Spring 97 is compressed between plate 90 and cross member 101 to urge upper wheel 36 against lower wheel 44. By operating crank 96 the amount that spring 97 is compressed, and therefore the force urging upper wheel 36 against lower wheel 44, can be adjusted. Pointer 102 is mounted to upper cup member 99 and provides a visual indication on scale 104 (shown in FIG. 1) of the force urging the wheels together.

During practice when the batter swings bat 48 through nip 46, upper arm 30 and lower arm 38 will swing apart, thereby compressing spring 97. After the bat has passed through nip 46, spring 97 will force upper arm 30 toward lower arm 38 until the outer circumference of upper wheel and lower wheels 36 and 44, respectively, meet.

Batting practice device 10 also includes an apparatus for varying a resistance to rotation of upper and lower wheels 36 and 44, respectively. FIG. 7 illustrates one preferred embodiment which comprises a hydraulic disk brake apparatus. Although FIG. 7 shows the device only on upper wheel 36, an identical apparatus can be included on lower wheel 44. Wheel 36 is mounted to upper arm 30 by means of axle 110. Rotor 112 is a metal disk which is mounted coaxially with and attached to wheel 36. Bracket 114 is mounted to a top side of upper arm 30 and supports brake caliper 116. Brake caliper 116 has a C-shaped opening which extends around an outer edge of rotor 112. Pistons 118 are hydraulically forced against rotor 112 and prevent upper wheel 36 from freely rotating. The degree to which upper wheel 36 will resist rotation depends upon the force hydraulic pistons 118 apply to rotor 112. Pistons 118 are hydraulically actuated, preferably by means of pump 74, although in alternative embodiments a hand-operated pump is used. Dial 119 on control box 49 is used to adjust the hydraulic force of pistons 118.

Figure 8:
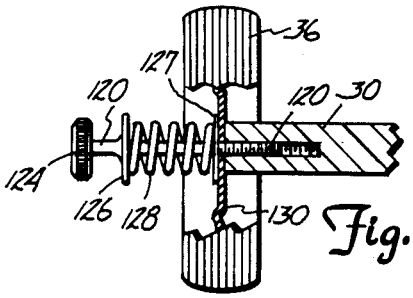
FIG. 8 is a detailed view of a spring biased friction apparatus used to vary the resistance to rotation of the upper and lower wheels.

Another preferred embodiment of the apparatus for varying the resistance to rotation of wheels 36 and 44 is illustrated in FIG. 8. This embodiment comprises a hand-adjusted spring biased apparatus. As shown, upper wheel 36 is mounted to upper arm 30 by means of threaded axle 120. An inner end of axle 120 is screwed into a threaded bore 122 within upper arm 30. Positioned on an outer end of axle 120 is hand crank 124. A first washer 126 is secured to an intermediate portion of axle 120 while a second washer 127 is movably fit around axle 120 at a point adjacent to hub 130 of wheel 36. Helical spring 128 is fit around axle 120 between first and second washers 126 and 127, respectively. Spring 128 is compressed to force hub 130 of wheel 36 against upper arm 30 thereby providing resistance to rotation of wheel 36. By operating hand crank 124 to move axle 120 in and out of upper arm 30, the compression of spring 128 and the force exerted onto hub 130 can be varied. Batters of differing strength, and increasing strength of individual batters can be accommodated in this manner.

To absorb the shock of contact with the bat and prevent rebounding as bat 48 strikes nip 46, wheels 36 and 44 are formed of relatively elastic material. In a preferred embodiment, wheels 36 and 44 are comprised of polyurethane foam which is formed around a hard plastic hub. The outer circumference of wheels 36 and 44 is a polyurethane surface of 30 durometer hardness. This material does not make marks on the bat, yet provides enough friction to grip the bat as it passes through the nip. Friction can be further increased by roughing the outer circumference of the wheels. This can be done by forming the wheels in a sand blasted mold.

An advantage of batting practice device 10 is its versatility. The device can be used to practice swinging to many different types of pitches. For example, if it is desired to practice swinging at high and outside pitches, upper section 15 of frame 13 will be raised and tilted inward so that bat 48 will pass in a perpendicular manner through nip 46. Similarly, it may be desired to practice swinging at low or outside pitches. Frame 13 is simply lowered and tilted outward so that as the batter swings down to reach these types of pitches, bat 48 passes through nip 46 in a perpendicular manner.

In addition to teaching proper hand-eye coordination by swinging the bat through the nip, batting practice device 10 can be used to increase the strength of a batter. By increasing a resistance to rotation of upper and lower wheels 36 and 44, respectively, as well as increasing the bias force by which these wheels are urged together, it will become increasingly difficult for the batter to swing bat 48 through nip 46. These forces can be slowly increased commensurate with an increase in the batter's strength and skills. The apparatus also works equally well with left or right-handed batters.

To summarize, the present invention is a batting practice device which will increase the skill and strength of a batter. The apparatus is very versatile in that it can be positioned to practice swinging at a variety of different types of pitches. Although the present invention has been described with reference to preferred embodiments, workers skilled in the art will recognize that changes may be made in form and detail without departing from the spirit and scope of the invention.

What is claimed is:

1. A batting practice device including:

a base;

a frame mounted to the base and oriented in a generally vertical position;

first wheel means which is undriven except when contacted by a baseball bat in use having an outer circumference and being mounted with respect to the frame for rotation about an axis generally perpendicular to the frame;

second undriven wheel means which is undriven except when contacted by a baseball bat in use having an outer circumference and being mounted with respect to the frame for rotation about an axis generally perpendicular to the frame;

means for mounting the first and second wheel means to the frame and for allowing relative movement therebetween, the outer circumference of the first wheel means cooperating with the outer circumference of the second wheel means to form an unobstructed nip through which a bat is swung during practice; and bias means for applying a bias force to urge the outer circumferences of the first and second wheel means together.

2. The device of claim 1 and including means for raising and lowering the frame with respect to the base.

3. The device of claim 2 and including means for pivotally mounting the frame to the base.

4. The device of claim 3 and including means for orienting the frame in a position tilted with respect to the base.

5. The device of claim 2 wherein the frame is generally rectangular in shape and includes a lower section mounted to the base and an upper section which slides up and down on the lower section.

6. The device of claim 1 and including means for adjusting the bias force.

7. The device of claim 1 and including means for varying a resistance to rotation of the first and second wheel means.

8. The device of claim 1 wherein the means for mounting the first wheel means to the frame includes:

an upper arm pivotally mounted to the frame and extending in a direction generally perpendicular to the frame.

9. The device of claim 7 wherein the means for mounting the second wheel means to the frame includes:

a lower arm rigidly mounted to the frame below the upper arm and extending in a direction generally perpendicular to the frame.

10. The device of claim 8 wherein the bias means includes:

a spring positioned on a top side of the first arm means; and compression means attached to and adjustable with respect to the frame for compressing the spring against the first arm means.

11. The device of claim 10 and including a crank for adjusting the compression means.

12. The device of claim 11 wherein the compression means includes:

a bracket mounted to and extending in a perpendicular direction with respect to the frame and having a threaded bore vertically aligned with the spring;

a threaded rod fitting into the threaded bore in the bracket; and a cup-shaped element opening in a downward direction having a base attached to a lower end of the threaded rod and having an opening which surrounds an upper portion of the spring.

13. The device of claim wherein the first and second wheel means include circular wheels.

14. The device of claim 1 wherein the outer circumferences of the first and second wheel means are comprised of a polyurethane material to absorb shock, prevent rebounding, and grip the bat as it passes through the nip.

15. The device of claim 1 wherein a center hub of the first and second wheel means is comprised of hard plastic.

16. The device of claim 1 wherein the means for varying the resistance to rotation of the upper and lower wheel means includes disc brake means.

17. The device of claim 1 wherein the means for varying the resistance to rotation of the upper and lower wheel means includes adjustable spring bias means.

18. The device of claim 1 and including hydraulic means for raising and lowering the frame.

19. The device of claim 1 and including hydraulic means for orienting the frame in a tilted position with respect to the base.

20. The device of claim 1 and including wheels rotatably attached to a lower portion of the frame for allowing the batting practice device to be rolled to and from a practice area.

21. A batting practice device including:

a base;

a frame mounted to the base and oriented in a generally vertical position;

an upper arm pivotally mounted to the frame and extending in a direction generally perpendicular to the frame;

an upper wheel which is undriven except when contacted by a baseball bat in use having an outer circumference and being rotatably mounted to the upper arm for rotation about an axis generally perpendicular to the frame;

a lower arm rigidly mounted to the frame at a position below the upper arm and extending in a direction generally perpendicular to the frame;

a lower wheel which is undriven except when contacted by a baseball bat in use having an outer circumference and being rotatably mounted to the lower arm for rotation about an axis generally perpendicular to the frame, the outer circumference of the lower wheel cooperating with the outer circumference of the upper wheel to form an unobstructed nip through which a bar is swung during practice; and bias means for applying a bias force to urge the outer circumferences of the upper and lower wheels together.

22. The device of claim 21 and including means for raising and lowering the frame with respect to the base.

23. The device of claim 22 and including means for pivotally mounting the frame to the base.

24. The device of claim 23 and including means for orienting the frame in a position tilted with respect to the base.

25. The device of claim 21 and including means for adjusting the bias force.

26. The device of claim 21 and including means for varying a resistance to rotation of the upper and lower wheels.

27. The device of claim 21 and including wheels rotatably mounted to a lower portion of the frame for allowing the batting practice device to be rolled to and from a practice area.

28. An athletic training device used to practice swinging an elongated athletic implement adapted to strike an athletic projectile, including:

a base;

a frame mounted to the base;

first wheel means which is undriven except when contacted by the athletic implement in use having an outer circumference and being mounted with respect to the frame for rotation about an axis generally perpendicular to the frame;

second wheel means which is undriven except when contacted by the athletic implement in use having an outer circumference and being mounted with respect to the frame for rotation about an axis generally perpendicular to the frame;

means for mounting the first and second wheel means to the frame and for allowing relative movement therebetween, the outer circumference of the first wheel means cooperating with the outer circumference of the second wheel means to form an unobstructed nip through which the elongated athletic implement is swung during practice; and bias means for applying a bias force to urge the outer circumferences of the first and second wheel means together.

29. The athletic training device of claim 28 and including means for adjusting position and orientation of the frame with respect to the base.

30. The athletic training device of claim 28 and including means for adjusting the bias force.

31. The athletic training device of claim 28 and including means for varying a resistance to rotation of the first and second wheel means.

32. The athletic training device of claim 28 wherein the means for mounting the first wheel means to the frame includes:

a first arm pivotally mounted to the frame and extending in a direcion generally perpendicular to the frame.

33. The athletic training device of claim 32 wherein the means for mounting the second wheel means to the frame includes:

a second arm rigidly mounted to the frame and extending in a direction generally perpendicular to the frame.

34. The athletic training device of claim 28 wherein the first and second wheel means include circular wheels.

* * * * *